United States Patent [19]

Beskin

[11] 4,332,364

[45] Jun. 1, 1982

[54] EASEL

[75] Inventor: Gerald S. Beskin, Minneapolis, Minn.

[73] Assignee: Therapac Div., Krelitz Industries, Inc., Minneapolis, Minn.

[21] Appl. No.: 109,836

[22] Filed: Jan. 7, 1980

[51] Int. Cl.[3] ..... B41J 11/02

[52] U.S. Cl. ..... 248/442.2

[58] Field of Search ..... 248/442.2, 447, 454, 248/457, 458

[56] References Cited

U.S. PATENT DOCUMENTS

| | | | |
|---|---|---|---|
| 1,221,369 | 4/1917 | Osborn | 248/442.2 |
| 2,286,048 | 6/1942 | Bahr | 248/442.2 |
| 2,306,659 | 12/1942 | Wise | 248/442.2 |

FOREIGN PATENT DOCUMENTS

| | | | |
|---|---|---|---|
| 371611 | 3/1923 | Fed. Rep. of Germany | 248/442.2 |

*Primary Examiner*—Patrick D. Lawson

*Attorney, Agent, or Firm*—Schroeder, Siegfried, Vidas, Steffey & Arrett

[57] ABSTRACT

An easel of the type having a generally planar material prop and a support to maintain the prop at a desired attitude. The support includes a plate which is adapted to be releasably affixed to a surface and a hinge formed of first and second members each having a base and extending legs. Each member base is secured to a different one of the prop and plate in a manner which allows a selective relative rotational movement between the base and the associated prop or plate. The axis of rotation is generally perpendicular to the associated one of the prop and plate. The legs are secured to each other in a manner which allows a selective relative pivoting movement of the members about an axis spaced from their bases.

6 Claims, 2 Drawing Figures

EASEL

DESCRIPTION

Background of Prior Art

Easels for the support of papers, books, artist's canvases, etc., are known to the prior art. Typically, they are formed by a generally planar prop for the material to be supported and a support for the prop to maintain it at a desired attitude. The supports have included tripods, bases and other similar structures and commonly require a horizontal surface upon which they may rest.

Easels for use in conjunction with typewriting are commercially available and include a prop and a base, the base being adapted to sit on a desk adjacent to the typewriter. No height adjustment is provided by these easels nor is a reorientation in attitude possible. Further, their use requires a clear surface area adjacent the typewriter. These factors often result in less than optimal placement of the materials to be supported by the easel and there may be glare problems which are not easily dealt with.

BRIEF SUMMARY OF THE INVENTION

The present invention provides an easel of the type having a generally planar prop for the materials to be supported and a support for the prop that allows the prop to be selectively reoriented. A plate is provided which is adapted to be affixed to a surface such as a typewriter housing. A hinge is formed of first and second members, each having a base and extending legs with the bases being secured to a different one of the prop and plate. The bases are secured to the prop and plate in a manner which allows a selective relative rotational movement between the bases and the prop or plate about an axis generally perpendicular to the associated one of the prop and plate. The legs are secured to each other in a manner which allows a selective pivoting movement of the members relative to each other about an axis spaced from their bases. In a preferred embodiment, the first and second members are formed of generally identical U-shaped members. Fasteners, preferably bolts and wing nuts, are employed to secure the elements together. Set-tooth washers, or a similar friction increasing device, may be required between all contacting surfaces to assure that a desired attitude is maintained when the fasteners are tightened. The plate may be secured to the surface to which it is affixed in any desirable manner as through the use of an adhesive, for example. Alternatively, the plate and surface may be releasably affixed as through the use of a fastening system available commercially under the trademark VELCRO.

DETAILED DESCRIPTION OF THE INVENTION

Figure 1:
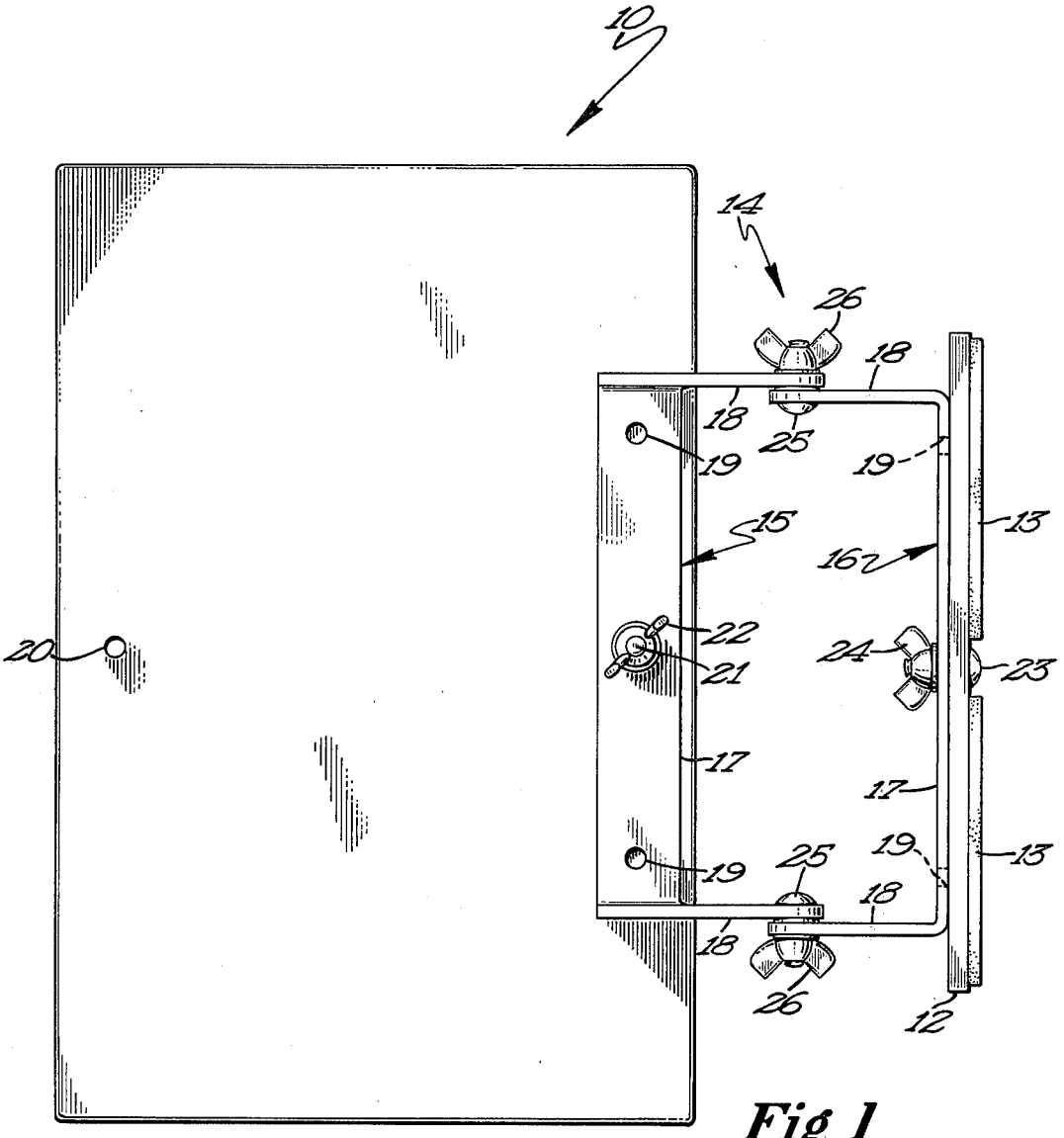
FIG. 1 illustrates a back view of a preferred embodiment of the present invention.
Figure 2:
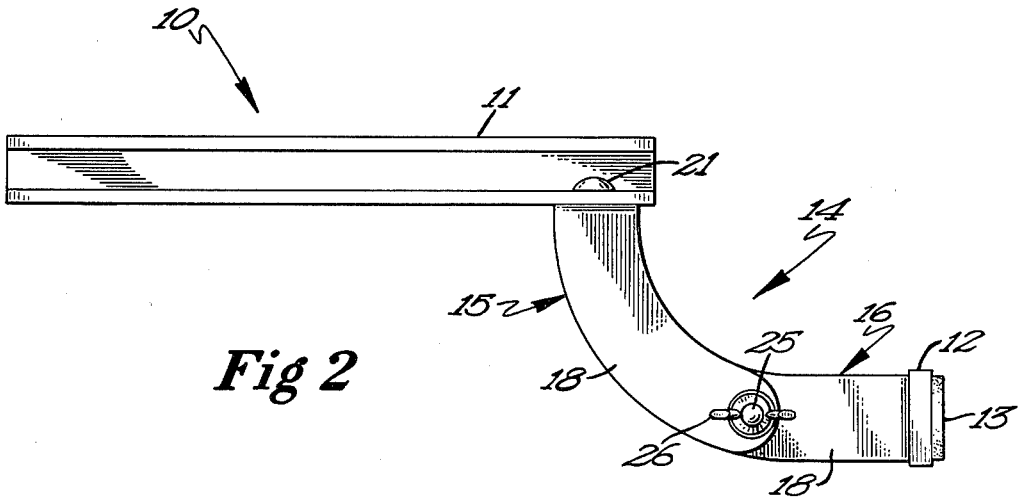
FIG. 2 is a top view of the preferred embodiment of FIG. 1.

Referring now to FIG. 1, there is illustrated a back view of a preferred embodiment of the present invention including a prop 10 having an extending lip 11 (see FIG. 2) which is adapted to accept and support materials such as papers, etc. A plate 12 has an adhesion system 13 applied to one surface thereof, the adhesion system serving to secure the plate 12 to a cooperating surface such as the outer surface of a typewriter housing. The adhesion system 13 may be an adhesive or, alternatively, a reusable adhesion system such as the type commercially available under the trademark VELCRO. The prop 10 and plate 12 are secured to each other via a hinge generally designated at 14. The hinge is formed of first and second generally U-shaped members 15 and 16 which may be identical. Each of the members 15 and 16 has a base portion 17 and extending legs 18. Each of the bases 17 is connected to a different one of the prop 10 and plate 12, the legs 18 of member 15 being secured to the legs 18 of member 16, as illustrated.

The securement of the elements forming the present invention is designed to allow a selective relative movement between those elements to provide the capability of reorienting the prop attitude. For example, each of the bases 17 is provided with a plurality of holes 19 while the prop 10 is provided with holes 20 adjacent each vertical edge. A bolt 21 (see FIG. 2) may extend from the front surface of the prop 10 through one of the holes 20 and through one of the holes 19 in the base 17 of member 15 to be engaged by a wing nut 22. Tightening of the wing nut 22 will secure the base 17 of member 15 to the back of prop 10 in a manner which will prevent a relative movement therebetween. However, on loosening of the wing nut 22, a relative rotational movement between the hinge 14 and prop member 10 is allowed. The movement is about the axis of the bolt which is generally perpendicular to the plane of the prop 10. A similar arrangement is provided by bolt 23 and wing nut 24 between the plate 12 and the base 17 of member 16. Bolts 25 through legs 18 are engaged by wing nuts 26 and, when not tightened, allow a selective pivotal movement between the members 15 and 16 about the longitudinal axis of the bolts 25, which axis is spaced from the bases 17.

As noted above, a tightening of the wing nuts 22, 24, and 26 prevents a relative movement between the various elements forming the present invention. However, on loosening of those wing nuts, the elements through which the cooperating bolts pass may be moved relative to each other—a rotational movement between member 15 and prop 10 and member 16 and plate 12 and a pivotal movement between members 15 and 16. Thus, with plate 12 secured to a surface, the housing of a typewriter, for example, one or more of the wing nuts may be loosened to reorient prop 10 in any desired attitude. On tightening of the loosened wing nut or wing nuts, that attitude will be maintained until it is again desired to reorient the prop 10 attitude. Provision of holes 20 in prop 10 adjacent the two vertical edges allows for a right-hand or left-hand mounting. Provision of more than one hole 19 within the bases 17 allows for a height adjustment in accordance with which of the holes 19 the bolt and associated wing nut cooperate. By providing multiple holes 19 in each of the bases the amount of height adjustment, either upward or downward, is maximized. Plate 12 may be affixed to the surface in any desired manner and is preferably releasably affixed so that the easel of the present invention may be removed when it is not in use.

Obviously, many modifications and variations of the present invention are possible in light of the above teachings. For example, the legs need not have the arcuate configuration illustrated in FIG. 2. Instead, they may take any desired configuration. However, the arcuate configuration illustrated, within the constraint that the members 15 and 16 are identical, maximizes the lateral extension of prop 10 from the plate 12 for given length of leg 18. It is therefore to be understood that, within the scope of the appended claims, the invention may be practiced otherwise than as specifically described.

I claim:

1. In an easel of the type having generally planar material prop means and means supporting said prop means at an attitude, the improvement wherein said supporting means comprises plate means adapted to be affixed to a surface and hinge means formed of first and second members each having a base and extending legs, the base of said first and second members being secured to a different one of said prop means and plate means by means for allowing a selective relative rotational movement between said member bases and said prop means and plate means about axes generally perpendicular to the associated one of said prop means and plate means, said legs being secured to each other by means for allowing a selective relative pivoting movement of said first and second members about an axis spaced from said bases, said selective relative movements providing prop means attitude reorientation.

2. In an easel of the type having generally planar material prop means and means supporting said prop means at an attitude, the improvement wherein said supporting means comprises plate means provided with adhesion means for releasably affixing said plate means to a surface and hinge means formed of first and second generally identical U-shaped members each having a base and extending legs, the base of said first and second members being secured to a different one of said prop means and plate means by means for allowing and preventing a selective relative rotational movement between said member bases and said prop means and plate means about axes generally perpendicular to the associated one of said prop means and plate means, said legs being secured to each other by means for allowing and preventing a selective relative pivoting movement of said first and second members about an axis spaced from said bases, said selective relative movements providing prop means attitude reorientation.

3. In an easel of the type having generally planar material prop means and means supporting said prop means at an attitude, the improvement wherein said supporting means comprises plate means adapted to be affixed to a surface and hinge means formed of first and second members each having a base and extending legs, the base of said first and second members being secured to a different one of said prop means and plate means by threaded fastener means for allowing and preventing a selective relative rotational movement between said member bases and said prop means and plate means about axes generally perpendicular to the associated one of said prop means and plate means, said legs being secured to each other by threaded fastener means for allowing and preventing a selective relative pivoting movement of said first and second members about an axis spaced from said bases, said selective relative movements providing prop means attitude reorientation and said member base associated with said prop means being selectively received adjacent to a plurality of the edges of said prop means.

4. The easel of claim 3 wherein said first and second members comprise generally identical U-shaped members.

5. The easel of claim 4 wherein said plate means is provided with adhesion means for releasably affixing said plate to a surface.

6. The easel of claim 5 wherein said threaded means comprise wing nut means.

* * * * *